US005962211A

United States Patent [19]

Maronian et al.

[11] Patent Number: 5,962,211

[45] Date of Patent: Oct. 5, 1999

[54] PHOTOGRAPHIC IMAGE IMPROVEMENT IN SPECTRAL SENSITIZING DYE AND FILTER DYE HAVING SIMILAR SPECTRAL ABSORPTION CHARACTERISTICS

[75] Inventors: Roupen H. Maronian; Donald R. Diehl, both of Rochester; Pamela M. Ferguson, Farmington, all of N.Y.

[73] Assignee: Eastman Kodak Company, Rochester, N.Y.

[21] Appl. No.: 08/943,346

[22] Filed: Oct. 3, 1997

[51] Int. Cl.[6] ..... G03C 1/20; G03C 1/815

[52] U.S. Cl. ..... 430/584; 430/510; 430/522

[58] Field of Search ..... 430/584, 510, 430/512, 517, 570, 578, 522

[56] References Cited

U.S. PATENT DOCUMENTS

| | | | |
|---|---|---|---|
| 3,629,274 | 12/1971 | Oliver | 260/304 |
| 4,833,246 | 5/1989 | Adachi et al. | 544/82 |
| 4,877,721 | 10/1989 | Diehl et al. | 430/522 |
| 4,904,565 | 2/1990 | Schmidt et al. | 430/264 |
| 4,921,781 | 5/1990 | Takamuki et al. | 430/496 |
| 4,939,080 | 7/1990 | Hioki et al. | 430/576 |
| 4,963,476 | 10/1990 | Sugimoto et al. | 430/574 |
| 5,126,237 | 6/1992 | Okumura et al. | 430/584 |
| 5,238,798 | 8/1993 | Usami | 430/522 |
| 5,298,379 | 3/1994 | Adin et al. | 430/510 |
| 5,399,465 | 3/1995 | Baloga | 430/379 |
| 5,413,902 | 5/1995 | Hara et al. | 430/503 |
| 5,451,494 | 9/1995 | Diehl et al. | 430/522 |
| 5,518,876 | 5/1996 | Parton et al. | 430/573 |

FOREIGN PATENT DOCUMENTS

| | | |
|---|---|---|
| 0 577 189 A2 | 1/1994 | European Pat. Off. . |
| 0 766 132 A1 | 4/1997 | European Pat. Off. . |
| 05027370 | 5/1993 | Japan . |
| 1 216 203 | 12/1970 | United Kingdom . |

*Primary Examiner*—Thorl Chea
*Attorney, Agent, or Firm*—Paul A. Leipold

[57] ABSTRACT

The invention relates to a photographic element comprising at least one absorber dye and at least one sensitizing dye wherein the peak sensitivity of said absorber dye and said sensitizing dye are similar. This provides improved perceptual red detail in regions of high red density in the negative image.

3 Claims, 2 Drawing Sheets

PHOTOGRAPHIC IMAGE IMPROVEMENT IN SPECTRAL SENSITIZING DYE AND FILTER DYE HAVING SIMILAR SPECTRAL ABSORPTION CHARACTERISTICS

FIELD OF THE INVENTION

The invention relates to an element for forming photographic images. It particularly relates to sensitizing and absorbing dyes for color paper.

BACKGROUND OF THE INVENTION

Color photographic paper is used in a wide variety of photoprocessing machines, which include large-scale processors capable of providing large volumes of photographic prints under conditions of continuous operation, and small-scale processors that are used to produce smaller volumes of photographic prints under conditions of discontinuous operation. These machines are known to differ widely in mechanical design, and the operating conditions for these processors vary widely in ambient temperature and humidity due to the wide variety of environments for use.

To provide a color photographic paper that serves all the different machines and conditions and is tolerant of the wide fluctuations in environment, one must address the variation of color paper performance to changes in heat and humidity at the site of operation. One aspect of these variations relates to the sensitivity of the photographic paper to changes in heat. It is desirable to make photographic materials that are invariant to any changes in environmental temperature, such that the photographic response does not change when the ambient temperature fluctuates during the course of processor operations. Alternatively, satisfactory results can-be achieved when the photographic response is neutral with respect to changes in environmental temperature, that is, although the photographic material may have a different response as the temperature changes, the changes are not noticeable to the operator as the effects of temperature in each of the constituent layers are synchronized to annul the effect of the temperature changes.

In the manufacture of color photographic paper it is critical to maintain the activity of the photographic components such that the photographic response does not change during the course of manufacturing. To ensure a consistent outcome is obtained, it is necessary to monitor photographic activity in the process of manufacturing. During the course of manufacturing, many incidental changes can occur and impact photographic response characteristics such as photographic speed. These speed changes can be measured during the manufacturing process, and adjustments can be made to maintain a consistent response. It is of enormous benefit to the process of manufacturing photographic materials if adjustments to the levels of the components bear a linear response to the speed value. Additionally, it is obvious that if less material is utilized in obtaining the desired photographic effect, cost advantages can be accrued.

Advantages gained in the manufacture of color paper cannot be realized if photographic performance is jeopardized. Therefore, it is desired that manufacturing gains be made concomitantly with gains in photographic performance. It is known that visual sharpness of the photographic material is critical to its acceptability for use, and that changes in sharpness or detail can occur when changes are made in the process of manufacturing; thus, it is highly desirable that manufacturing changes do not degrade sharpness, and it is even more desirable that such changes lead to improved sharpness.

It is intended that color photographic paper satisfy the desires of photographers in the practice of their art. In the hands of the photographer it is common practice to regulate the exposure of photographic material under conditions where some areas of the print may receive greater light exposure than a normal exposure to "burn in" the desired image to a greater degree. Alternatively, it is also the practice to shield some areas of the print from normal exposure to light, and by "dodging" the light in this way create the desired image. In practicing the techniques of dodging and burning, the photographer or enlarger operator is hindered by the present color photographic material that has a dark color content prior to exposure. Color papers also vary in their undeveloped color from batch to batch, as different absorber dyes are added to adjust their properties. This makes the dodging and burning more difficult, as the paper looks different during exposure as the undeveloped paper color is different.

PROBLEM TO BE SOLVED BY THE INVENTION

There is a need for photographic paper that is more easily adjusted to control speed and sensitivity during manufacturing without sharpness loss.

SUMMARY OF THE INVENTION

It is an object of the invention to overcome disadvantages of prior photographic elements.

It is a further object of the invention to provide a color paper that is easier for the printer operator to accurately dodge and burn during printing.

A further object of the invention is to provide a color paper that has the sensitometric and speed properties adjusted during manufacturing without significantly changing the color of the undeveloped paper.

An additional object of the invention is to provide lower manufacturing cost for color papers.

These and other objects generally are accomplished by providing a photographic element comprising at least one absorber dye and at least one sensitizing dye wherein the peak sensitivity of said absorber dye and said sensitizing dye are the same.

ADVANTAGEOUS EFFECT OF THE INVENTION

An advantage of the invention is that color papers are produced that are easier to control as to sensitivity and speed during manufacturing.

DETAILED DESCRIPTION OF THE INVENTION

Figure 1:
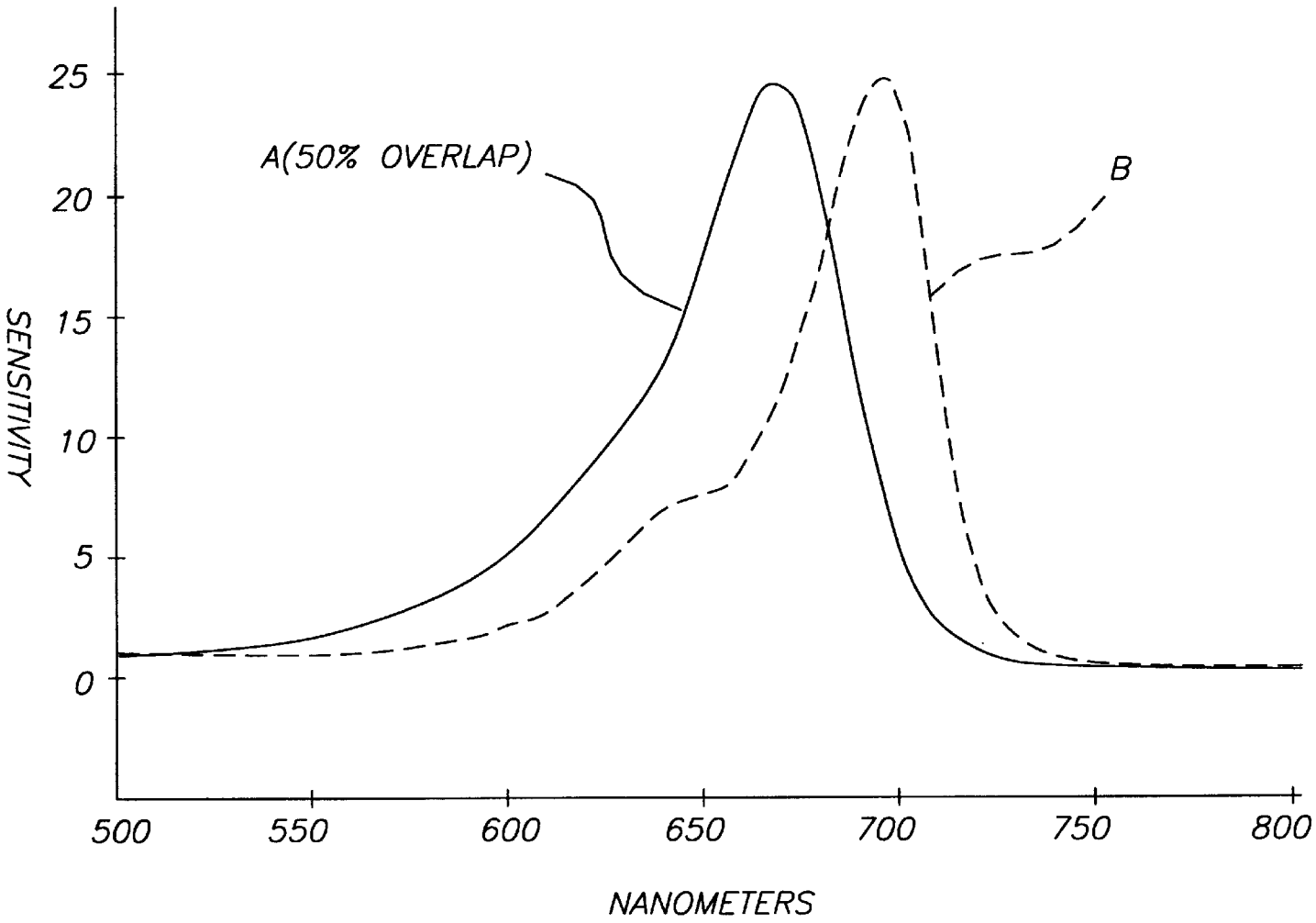
FIG. 1 is the dye sensitivity comparison of the spectral dye and absorber dyes such as in the prior art.

The invention has numerous advantages over prior photographic elements. The photographic elements of the invention are low cost manufacture, as absorber dye and sensitizing dye have the same peak response, less chemicals are needed to adjust the overall sensitivity of the photographic element. Further, the adjustment is more accurate. Since less absorbing dye is needed to make adjustments, the paper is lighter in color, as well as varying less in color between batches as different adjustments are made. There is a cost savings as less chemicals are utilized for adjusting the paper properties during manufacturing. Further, there is greater customer satisfaction as the paper always looks the same. Customers previously were uneasy in that the color of unexposed paper would vary even though the pictures developed from the paper were very uniform. Another advantage is that in printing photographs on the elements of the invention, the printer operator can more easily dodge and burn as the paper is light colored, and this light color does not vary significantly from batch to batch. These and other advantages of the invention will be apparent from the detailed description below.

In the manufacture of color paper and other photographic products such as color negative film, it is known to adjust the speed of the paper by the use of absorber dyes. These absorber dyes allow the photographic elements to be sold with a fixed speed over a period of time even though the speed of the photographic emulsions may vary somewhat in manufacture over time. By the use of the dyes, the speed is adjusted to a constant over time.

In the invention the absorber dye is selected to have similar response to light as the spectral sensitizing dyes for the emulsions. While absorber dyes have been used in the art, there is no recognition of the benefits of adjusting the band absorption of the absorber dyes to be generally the same as those of the spectral sensitizing dyes. It has been found that to obtain the benefits of the invention that the peak responses of the spectral sensitizing dye and the absorber dye should overlap for at least 75% of the spectral envelope of the spectral sensitizing dye. It is suitable that the dyes have a spectral envelope overlap of 75% or greater. Spectral envelope is the area underneath the spectral sensitization curve of the particular spectral sensitizing dye. The spectral sensitization curve is determined by the sensitivity of the silver halide to different wavelengths of light for a particular sensitizing dye. This is done by using a standard wedge spectrophotometer. It is preferred that the absorber dye overlap at least 90% or greater than 90% of the spectral envelope of the spectral sensitizing dye for the easiest adjustment of speed with the use of the least absorbing dye and best maintaining of the sharpness of the photographic element.

The invention may be utilized to match spectral sensitization and absorber dye in any color photographic product. The dye adjustment of peak sensitivity may be used in the red, blue, or green sensitive layer. A preferred use has been found to be in the red sensitive layer, as addition of the absorbing dyes in this layer results in a darker photographic element that makes printing more difficult, as dodging and burning is more difficult to carry out on the dark color, color paper, and presently used dyes are wide apart in peak sensitivity. Linear adjustment of speed values during manufacturing is possible when the absorber and spectral dyes have the same peak as in the invention.

Any red spectral sensitizing dye may be utilized in the red light sensitive layer of a photographic element. Suitable for use in color paper are the red sensitizer dyes symmetrical or unsymmetrical benzothiazoledicarbocyanines, benzoxazole dicarbocyanines, benzothiazole-benzoxazole dicarbocyanines, for example, those sensitizing dyes described in *Research Disclosure* #38957, September 1996. Preferred for use in color paper are sensitizer dyes symmetrical or unsymmetrical benzothiazoledicarbocyanines. Preferred materials are those of Class A and Class B.

Class A dyes have structure I (and substituents $W_1$–$W_8$ are chosen such that J is ≧0.0, where J is defined as the sum of the Hammett $s_p$ values of $W_{1-8}$, or, alternatively, Class A dyes can also have the structure II provided substituents $W_1$–$W_8$ are chosen such that J is ≧0.24;

Class B dyes have structure II and substituents $W_1$–$W_8$ are chosen independently such that J is ≦0.10, or, alternatively, Class B dyes can also have structure I provided substituents $W_1$–$W_8$ are chosen such that J is ≦-0.14

(I)

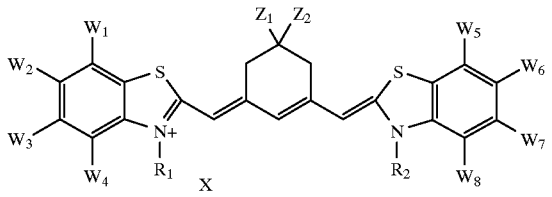

(II)

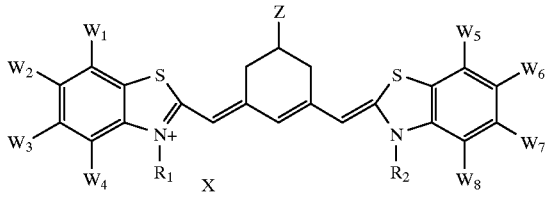

where $R_1$ and $R_2$ each independently represents an alkyl group or a substituted alkyl group;

X is a counterion, if needed, to balance the charge of the dye;

Z is a hydrogen or halogen atom or an alkyl group or a substituted alkyl group;

$Z_1$ and $Z_2$ is each independently a 1–8 carbon alkyl group;

A preferred sensitizing dye is

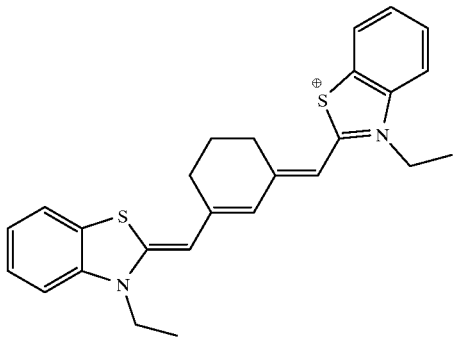

Any red absorber dye may be used in the invention. Suitable red absorber dyes are (I)

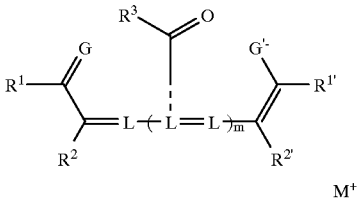

wherein:

G is oxygen, substituted nitrogen, or $C(CN)_2$;

$R^1$, $R^{1'}$, $R^2$, $R^{2'}$ independently represent H or a substituent, or $R^1$ and $R^2$, $R^{1'}$ and $R^{2'}$ may form a ring;

$R^3$ is an alkyl, aryl, alkyloxy, aryloxy, amino, or heterocyclic, any of which may be substituted or unsubstituted;

m is 0, 1, 2, or 3;

all of the L together define a methine chain, each L representing a methine any of which may be substituted or unsubstituted; and $M^+$ is a cation.

Preferred red absorber dyes have a peak sensitivity the same as the peak sensitivity of the preferred sensitizing dyes. Preferred absorber dye is D-7.

The selection of pairs of absorber and sensitizing dyes having the same peak sensitivites for the green sensitive and blue sensitive layers also may be carried out.

The spectral envelope of a dye may be determined by several techniques. A suitable technique is absorbance spectrophotometry.

Illustrated in FIG. 1 attached are figures illustrating the overlapping of the spectral sensitivity of the red sensitizing dye and red absorbing dye of a representative prior art paper. As can be seen, the spectral red absorber dye curve A does not closely match the spectral sensitizing dye curve B of the absorbing dye. The area underneath the curves above the horizontal axis is referred to as the spectral envelope with a dye. As can be seen in the drawing of FIG. 1, the overlap is at about 50%. The failure of the dye to have the same peak sensitivity means that more of the absorbing dye needs to be added to control the response of the sensitizing dye than if the peaks were the same. This leads to the following disadvantages. The color paper is darker and, therefore, more difficult for a printer operator to burn and dodge. Also, sharpness can only be obtained at high and expensive amounts of absorber dyes. Also, detail is less because less cyan dye is formed in the paper due to green exposure from the higher red density regions of the negative image.

Figure 2:
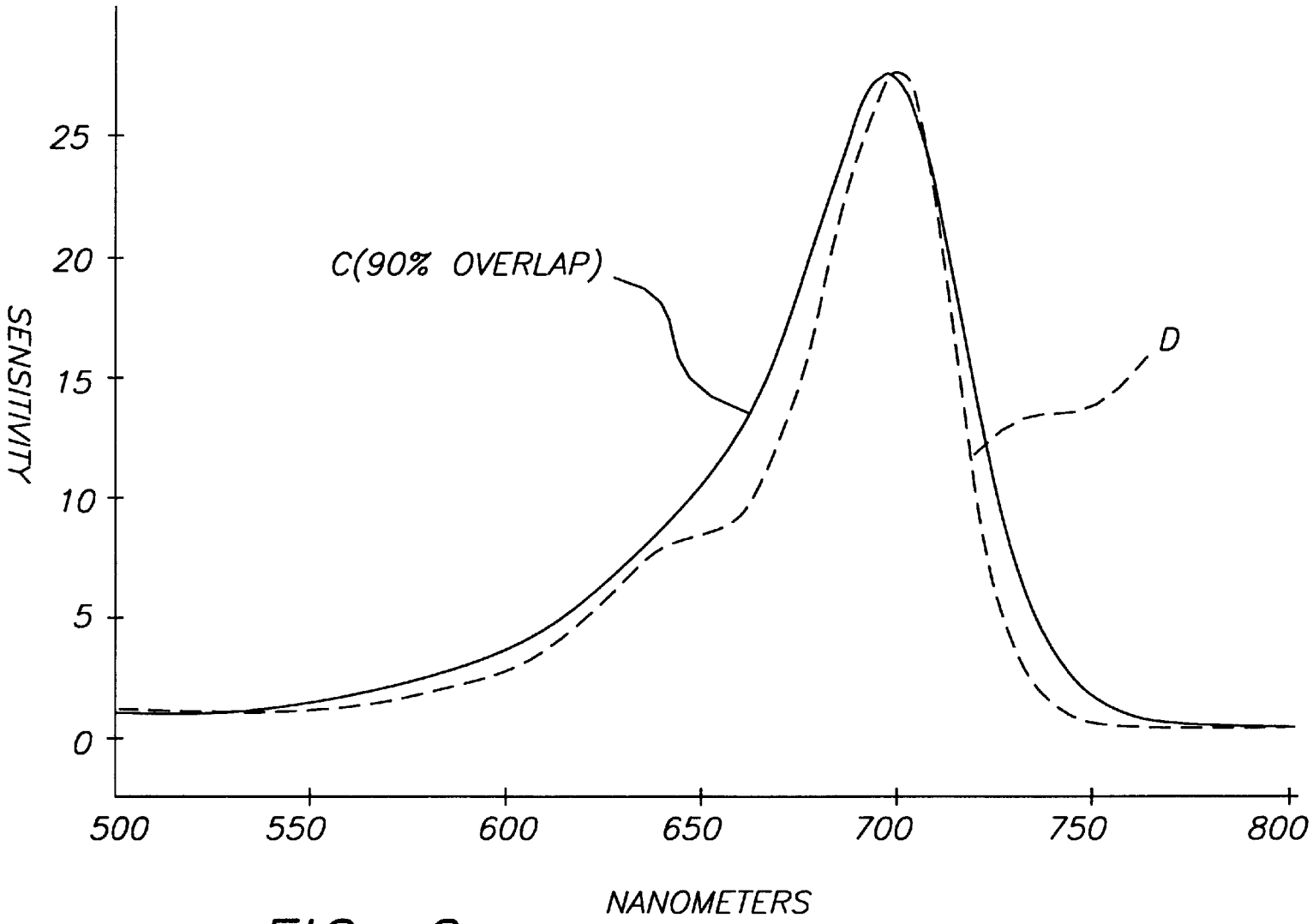
FIG. 2 is the dye sensitivity comparison of a spectral dye and absorber dyes in accordance with the invention.

In FIG. 2, there is shown a pair of red sensitizing dye 8 (curve D) and red absorbing dye 7 (curve C) curves of dyes of the invention. As shown in FIG. 2, these dyes have a peak sensitivity that overlaps at about 90% of their spectral envelope. This leads to the advantage that less dye is needed to change the sensitivity to the same degree, and further red detail is enhanced because additional cyan dye is formed as a result of increased paper red sensitivity (in the 625–700 nm spectral region) in the red regions of the image. The resulting invention's overall red sensitivity is increased, compared to the current papers, in the above-specified spectral region. This increased red spectral sensitivity region (in the photographic paper) forms proportionately more cyan image dye yielding improved perceptual red detail. Further, sharpness is not deteriorated because control is now linear and further sharpness can be achieved with less absorber dye than in FIG. 1.

The invention may be suitably practiced in any photographic material. Suitable for use of the invention are transparency materials, reversal transparency materials, movie internegative film, and movie film. The invention also is suitable for color negative film. The invention finds its most preferred use in negative working color paper where the maintenance of red detail advantage in manufacturing is achieved. The invention may be utilized with any silver halide grains and color couplers conventionally utilized in color papers and color negative film. Further, it may be utilized with any conventional spectral sensitizing dyes for which a spectral envelope matching absorbing dye is available. Typical of materials suitable for the invention are those found in *Research Disclosure* 38957, September 1996, p. 592, Color paper materials suitable for the invention may be found in *Research Disclosure* 37038, February 1995, p. 79–115.

The following examples illustrate the practice of this invention. They are not intended to be exhaustive of all possible variations of the invention. Parts and percentages are by weight unless otherwise indicated.

EXAMPLES

Preparation of Example 1

Preparation of emulsion E1. A high chloride silver halide emulsion was precipitated by adding approximately equimolar silver nitrate and sodium chloride solutions into a reactor vessel containing a gelatin peptizer and a thioether ripener. An osmium dopant was added during the silver halide grain formation for most of the precipitation followed by shelling without dopant. The resultant emulsion contained cubic shaped grains of 0.76 mm in edgelength size. The emulsion was optimally sensitized by the addition of a colloidal suspension of aurous sulfide followed by a heat ramp, and addition of sensitizing dye, D-1, 1-(3-acetamidophenyl)-5-mercaptotetrazole and potassium bromide. In addition, iridium and ruthenium dopants were added during the sensitization process.

Preparation of emulsion E2. A high chloride silver halide emulsion was precipitated by adding approximately equimolar silver nitrate and sodium chloride solutions into a reactor vessel containing a gelatin peptizer and a thioether ripener. An osmium dopant was added during the silver halide grain formation for most of the precipitation followed by shelling without dopant. The resultant emulsion contained cubic shaped grains of 0.30 mm in edgelength size. The emulsion was optimally sensitized by the addition of a colloidal suspension of aurous sulfide followed by a heat ramp, and addition of an iridium dopant, Lippmann bromide and 1-(3-acetamidophenyl)-5-mercaptotetrazole, sensitizing dye, D-2, and further 1-(3-acetamidophenyl)-5-mercaptotetrazole.

Preparation of emulsion E3. A high chloride silver halide emulsion was precipitated by adding approximately equimolar silver nitrate and sodium chloride solutions into a reactor vessel containing a gelatin peptizer and a thioether ripener. The resultant emulsion contained cubic shaped grains of 0.40 mm in edgelength size. The emulsion was optimally sensitized by the addition of a colloidal suspension of aurous sulfide followed by a heat ramp, and addition of 1-(3-acetamidophenyl)-5-mercaptotetrazole, potassium bromide and red sensitizing dye, D-3. In addition, iridium and ruthenium dopants were added during the sensitization process.

The emulsions were combined with dispersions using techniques known in the art and the resulting light-sensitive silver halide components were applied to polyethylene resin coated paper support as described in coating format 1 to provide Example 1. The amount of absorber dye in Example 1 was adjusted as shown in Table 1 to give samples 101–106.

Preparation of Example 2

Example 2 was prepared as described in Example 1 except that D-6 was replaced by D-7 in coating format 1. The amount of absorber dye in Example 2 was adjusted as shown in Table 1 to give samples 201–206.

Preparation of Example 3

Example 3 was prepared as described in Example 1 except that D-3 was replaced by D-8 in coating format 1. The amount of absorber dye in Example 3 was adjusted as shown in Table 2 to give samples 301–303.

Preparation of Example 4
Example 4 was prepared as described in Example 2 except that D-3 was replaced by D-8 in coating format 1.
The amount of absorber dye in Example 4 was adjusted as shown in Table 2 to give samples 401–403.
GSD-1 D-2
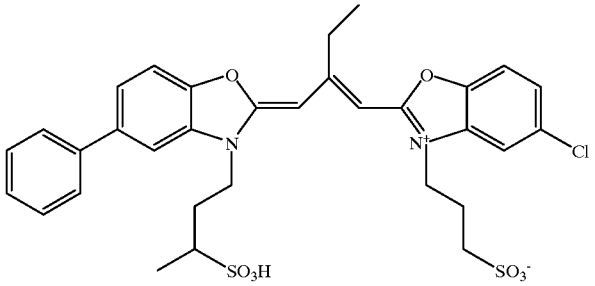
RSD-1 D-3
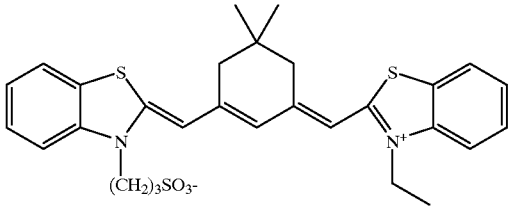
D-8
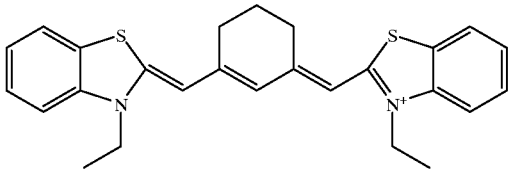
D-7
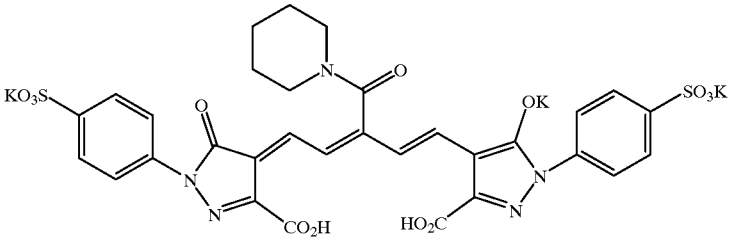
D-1
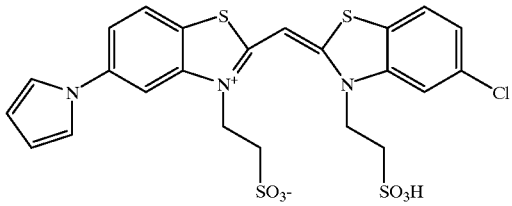
COATING FORMAT 1
| | g/m$^2$ |
|---|---|
| Layer 1 | |
| Gelatin | 1.321 |
| Silver (E1) | 0.203 |
| Y1 | 0.418 |
| S-1 | 0.285 |
| ST-1 | 1.393 |
| D-4 | 0.008 |
| Layer 2 | |
| Gelatin | 0.65 |
| SC-1 | 0.057 |

-continued
| | |
|---|---|
| S-1 | 0.163 |
| Layer 3 | |
| Gelatin | 1.087 |
| Silver (E2) | 0.172 |
| M-1 | 0.365 |
| S-2 | 0.635 |
| S-3 | 0.059 |
| ST-2 | 0.404 |
| SC-1 | 0.037 |
| D-5 | 0.006 |
| Layer 4 | |
| Gelatin | 0.849 |
| UV-1 | 0.062 |
| UV-2 | 0.353 |
| SC-1 | 0.085 |
| S-4 | 0.138 |
| Layer 5 | |
| Gelatin | 1.198 |
| Silver (E3) | 0.19 |
| C-1 | 0.365 |
| S-1 | 0.358 |
| UV-2 | 0.235 |
| S-3 | 0.03 |
| D-6 | 0.02 |
| Layer 6 | |
| Gelatin | 0.645 |
| UV-1 | 0.048 |
| UV-2 | 0.277 |
| SC-1 | 0.067 |
| S-4 | 0.108 |
| Layer 7 | |
| Gelatin | 0.697 |
| Surfactant | 0.04 |
| Lubricant | 0.027 |
STRUCTURES
Y-1
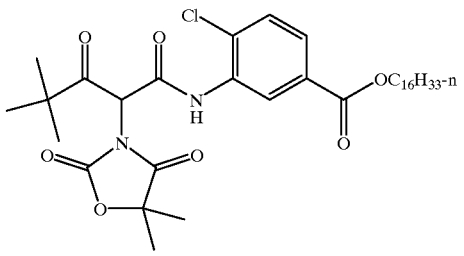
dibutyl phthalate
S-2
ST-1
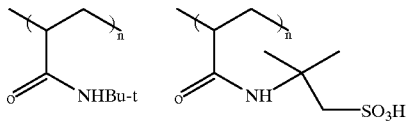
(99:1) mw = 75–80,000
D-4
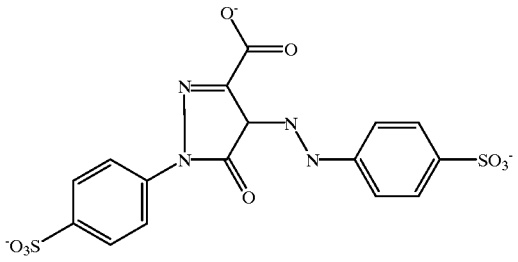

-continued
SC-1
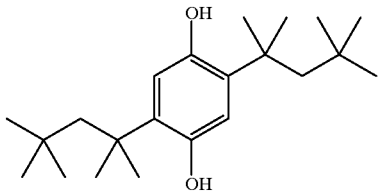
M-1
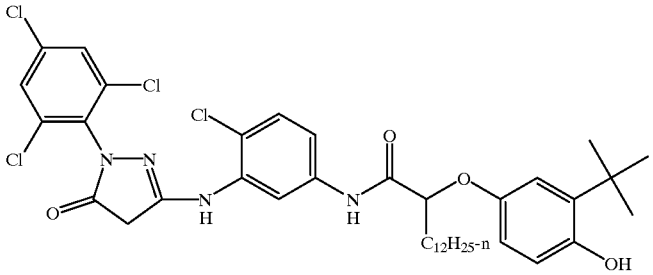
2-(2-Butoxyethoxy)ethyl acetate S-3
ST-2
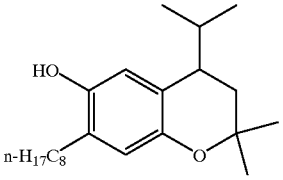
D-5
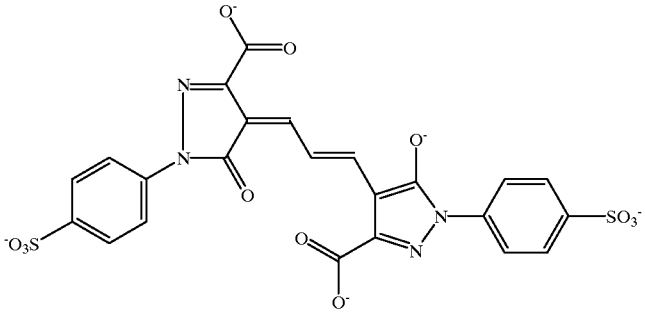
UV-1
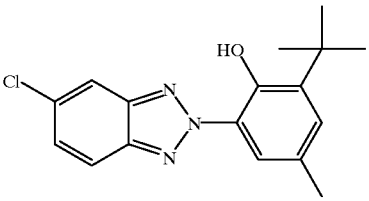
UV-2
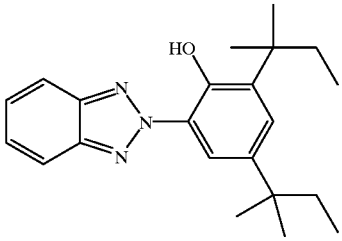
1,4-Cyclohexyldimethylene bis(2-ethylhexanoate) S-4

-continued

C-1

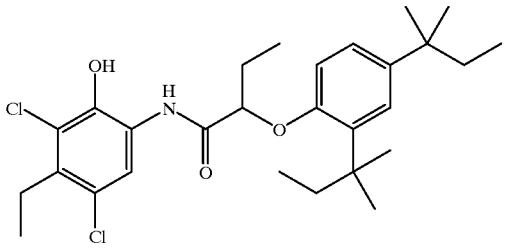

D-6

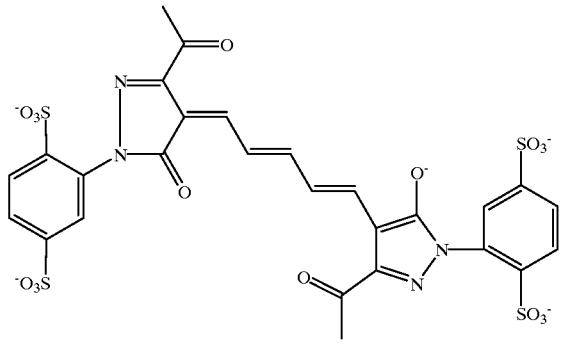

TABLE 1

| Sample | Dye | Laydown mg/ft$^2$ | Sharpness | Speed | Comment |
|---|---|---|---|---|---|
| 101 | D-6 | 0 | 89 | 0.38 | comparison |
| 102 | D-6 | 0.25 | 89.3 | 0.28 | comparison |
| 103 | D-6 | 0.55 | 89.7 | 0.19 | comparison |
| 104 | D-6 | 1.1 | 90.3 | 0.08 | comparison |
| 105 | D-6 | 1.65 | 90.4 | −0.03 | comparison |
| 106 | D-6 | 2.25 | 90.3 | 0.01 | comparison |
| 201 | D-7 | 0 | 89.3 | 0.38 | comparison |
| 202 | D-7 | 0.25 | 89.7 | 0.2 | invention |
| 203 | D-7 | 0.55 | 89.9 | 0.08 | invention |
| 204 | D-7 | 1.1 | 90.5 | −0.16 | invention |
| 205 | D-7 | 1.65 | 90.5 | −0.3 | invention |
| 206 | D-7 | 2.25 | 91.1 | −0.38 | invention |

Table 1 shows that increasing amounts of the inventive dye lead to continued sharpness improvements, whereas the comparative dye reaches a maximum value in sharpness and further quantities do not provide any further sharpness improvements. It is also evident from Table 1 that the in-process speed will continue to decrease with increased amounts of the inventive dye, that is, it exhibits a linear relationship. The comparative dye fails to continue to decrease speed with increased amount of dye and exhibits a non-linear relationship. The inventive dye has the advantage of being useful over a greater range of adjustment during manufacturing. Further, it is apparent from Table 1 that a lesser amount of the inventive dye can be used to obtain the speed and sharpness position of the comparative dye.

TABLE 2

| Sample | Absorber Dye | Sensitizing Dye | Laydown mg/ft$^2$ | Heat Sensitivity | Speed | Comment |
|---|---|---|---|---|---|---|
| 103 | D-6 | D-3 | 0.55 | 0.019 | 0.19 | comparison |
| 106 | D-6 | D-3 | 2.25 | 0.018 | 0.01 | comparison |
| 203 | D-7 | D-3 | 0.55 | 0.029 | 0.08 | comparison |
| 206 | D-7 | D-3 | 2.25 | 0.052 | −0.38 | comparison |

TABLE 2-continued

| Sample | Absorber Dye | Sensitizing Dye | Laydown mg/ft$^2$ | Heat Sensitivity | Speed | Comment |
|---|---|---|---|---|---|---|
| 301 | D-6 | D-8 | 0.55 | −0.006 | 0.45 | comparison |
| 302 | D-6 | D-8 | 2.25 | −0.004 | 0.17 | comparison |
| 303 | D-6 | D-8 | 4.5 | 0.004 | −0.05 | comparison |
| 401 | D-7 | D-8 | 0.55 | 0.006 | 0.25 | invention |
| 402 | D-7 | D-8 | 2.25 | 0.006 | −0.13 | invention |
| 403 | D-7 | D-8 | 4.5 | 0.045 | −0.4 | invention |

Table 2 shows that the sensitivity to ambient temperature changes can be controlled by the inventive combination of absorber and sensitizing dyes which leads to greatly reduced sensitivity at the same laydown of absorber dye.

The invention has been described in detail with particular reference to preferred embodiments thereof, but it will be understood that variations and modifications can be effected within the spirit and scope of the invention.

We claim:

1. A color photographic paper element comprising, in a red sensitized layer, at least one absorber dye comprising KH
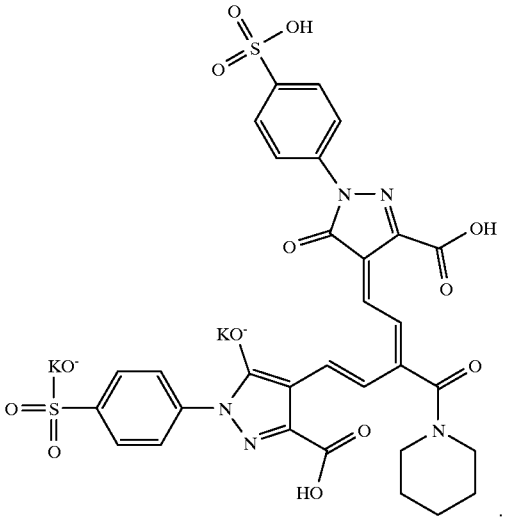
and at least one sensitizing dye comprising
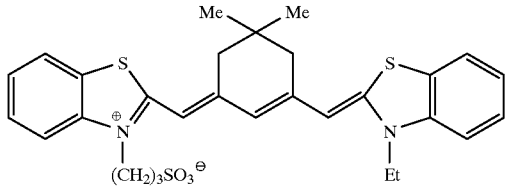
or
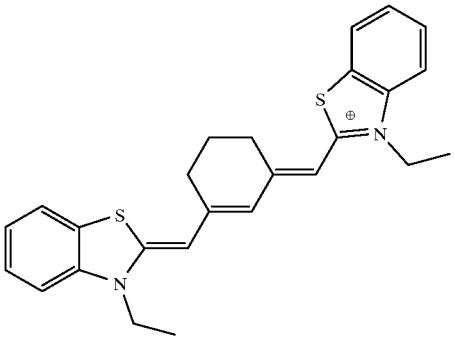
-continued
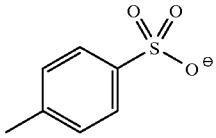
wherein the peak sensitivity of said absorber dye and said sensitizing dye overlap for greater than 90% of the spectral envelope.
2. The element of claim 1 wherein said peak sensitivities are within 0–25 nanometers of each other.
3. The element of claim 1 wherein said sensitizing dye comprises
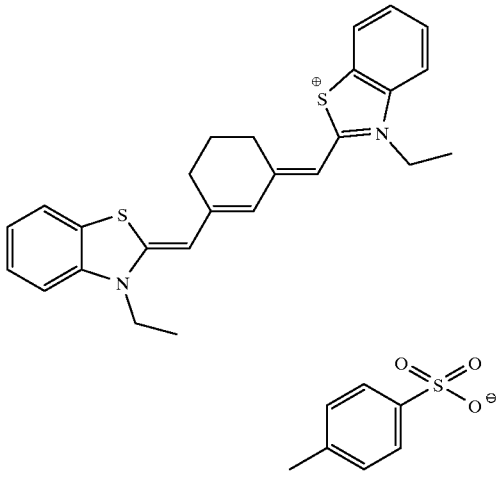
* * * * *